US007121440B2

(12) United States Patent
Kobayashi

(10) Patent No.: US 7,121,440 B2
(45) Date of Patent: Oct. 17, 2006

(54) MOTOR-DRIVEN STAPLER HAVING A DRIVER AND A CYLINDER UNIT THAT VERTICALLY RECIPROCATES

(75) Inventor: Hisashi Kobayashi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/525,537

(22) PCT Filed: Aug. 26, 2003

(86) PCT No.: PCT/JP03/10739

§ 371 (c)(1),
(2), (4) Date: Feb. 24, 2005

(87) PCT Pub. No.: WO2004/020154

PCT Pub. Date: Mar. 11, 2004

(65) Prior Publication Data

US 2005/0269381 A1 Dec. 8, 2005

(30) Foreign Application Priority Data

Aug. 30, 2002 (JP) ..... 2002-255020

(51) Int. Cl.
*B25C 7/00* (2006.01)

(52) U.S. Cl. ..... 227/5; 227/129; 227/124; 227/153; 227/155; 227/6; 227/7

(58) Field of Classification Search ..... 227/131, 227/129, 124, 153, 155, 5, 6, 7, 108, 110
See application file for complete search history.

(56) References Cited

U.S. PATENT DOCUMENTS 4,516,714 A * 5/1985 Braun et al. ..... 227/78
5,791,548 A * 8/1998 Udagawa et al. ..... 227/131
6,164,513 A * 12/2000 Yoshie ..... 227/155
6,592,115 B1 * 7/2003 Yamaguchi ..... 270/58.08
6,626,348 B1 * 9/2003 Kitamura ..... 227/155
6,719,181 B1 * 4/2004 Kanai et al. ..... 227/2
6,896,167 B1 * 5/2005 Haramiishi ..... 227/131
2003/0066858 A1 * 4/2003 Holgersson ..... 227/2
2005/0017048 A1 * 1/2005 Yoshie et al. ..... 227/111

FOREIGN PATENT DOCUMENTS

| | | |
|---|---|---|
| DE | 10246176 A1 | 4/2003 |
| JP | 61-166774 | 10/1986 |
| JP | 62-46324 | 10/1987 |
| JP | 7-505339 | 6/1995 |

* cited by examiner

*Primary Examiner*—Rinaldi I. Rada
*Assistant Examiner*—Brian Nash
(74) *Attorney, Agent, or Firm*—Chapman and Cutler LLP

(57) ABSTRACT

A stapler having a driver unit vertically separated from its clincher unit, which has a clincher base with a clincher. The clincher base is disposed to vertically reciprocate, and sheets inserted between the base and driver unit are clamped between the base and the driver unit when the base is reciprocated. The stapler has a first motor to operate the driver, and a second motor to reciprocate the clincher base and operate the clincher. In sequence, the second motor reciprocates the base and makes the base clamp the sheets, and then stops; the first motor makes the driver drive out the staple, and then stops; the second motor makes the clincher clinch the staple legs having passed the sheets, the base is returned, and the second motor stops; and after clinching, the first motor returns the driver to the initial position, and then stops.

4 Claims, 14 Drawing Sheets

MOTOR-DRIVEN STAPLER HAVING A DRIVER AND A CYLINDER UNIT THAT VERTICALLY RECIPROCATES

TECHNICAL FIELD

The present invention relates to staplers in which a driver unit is vertically separated from a clincher unit.

BACKGROUND OF THE INVENTION

There have been formerly known staplers in which a driver unit is vertically separated from a clincher unit (See JP-B 62-46324).

In such a stapler, the driver unit is arranged in a lower position, and the clincher unit is vertically movably arranged above the driver unit. The clincher unit is descended to clamp sheets placed on an upper face of the driver unit between the clincher unit and the driver unit. Then, a driver of the driver unit is operated to drive out a staple toward the sheets clamped. Then, a clincher of the clincher unit is operated to clinch leg portions of the stapler passing through the sheets.

However, according to the stapler, vertical movement of the driver unit and operations of the driver and the clincher are effected with a singe motor, using a cam mechanism, a link mechanism, etc. Thus, the structure of each of the mechanisms becomes complicated, unfavorably resulting in a large-scale stapler with these mechanisms. Further, since various operations are performed by the single motor, orientations of the driving unit and the clincher unit cannot be changed. Thus, the staple cannot be punched into the sheets in such a state that a back portion of the staple is oblique to the sheets.

It is an object of the present invention to provide a stapler which can simplify its mechanical structure and can change orientations of a driver unit and a clincher unit.

DISCLOSURE OF THE INVENTION

In order to attain the above object, the present invention is directed to a stapler comprising a driver unit having a driver for punching out a staple toward sheets, a clincher unit having a clincher base with a clincher to clinch leg portion of the staple passing through the sheets, the driver unit being vertically separated from the clincher unit, wherein the clincher base is vertically reciprocably disposed, and the sheets inserted between the clincher base and the driver unit is clamped between the clincher base and the driver unit when the clincher base is reciprocated, the stapler further comprising a first driving motor provided for the driver unit to operate the driver and a second driving motor provided for the clincher unit to reciprocate the clincher base and operating the clincher.

BEST MODE FOR CARRYING OUT THE INVENTION

In the following, an embodiment of the stapler according to the present invention will be explained with reference to the drawings.

Figure 1:
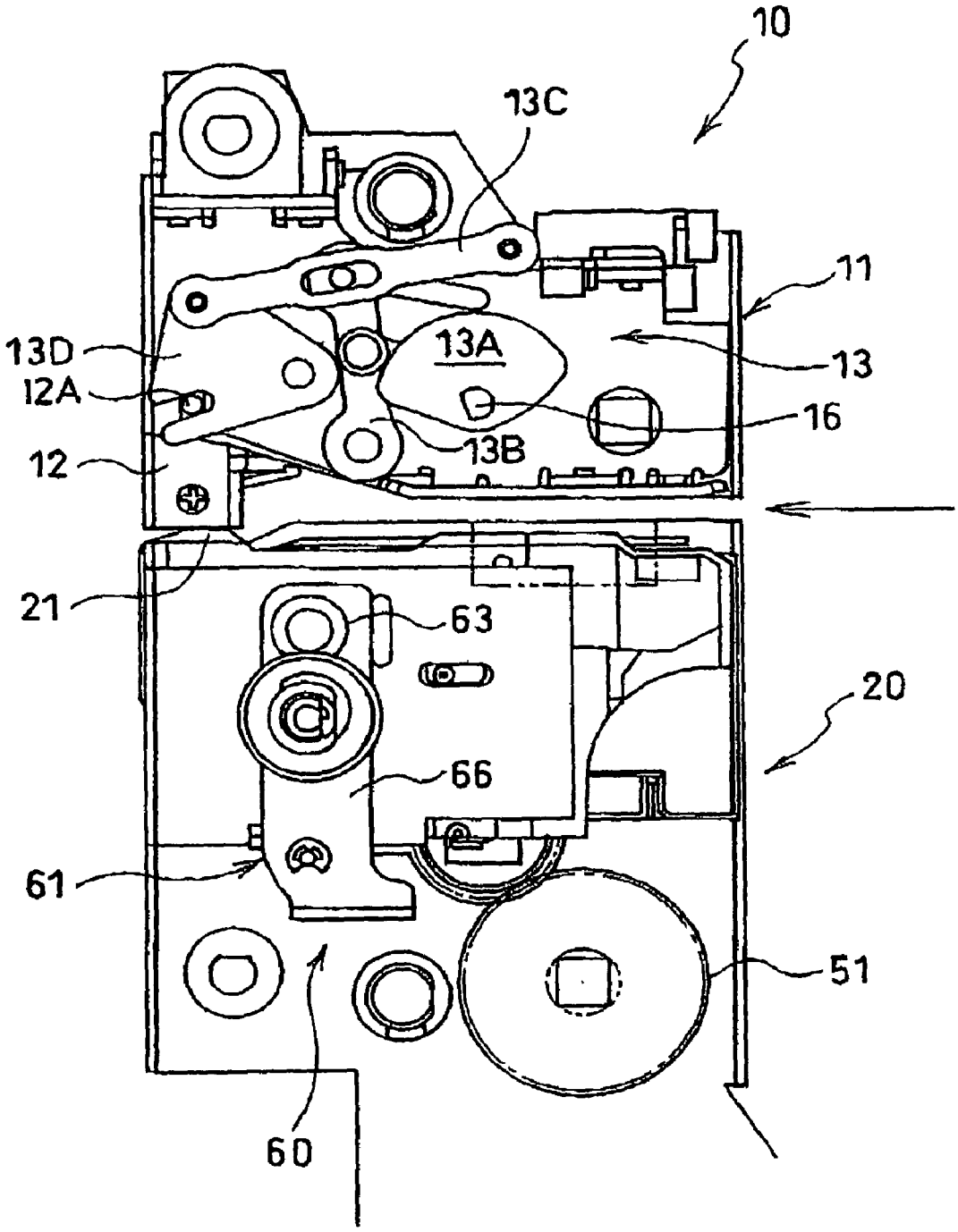
FIG. 1 is a side view showing the entire construction of a stapler according to the present invention.

FIG. 1 shows a stapler 10 to be fitted to a copier, for example. The stapler 10 comprises a clincher unit 11 and a driver unit 20. The clincher unit 11 is vertically separated from the driver unit 20.

(Clincher Unit)

The clincher unit 11 comprises a clincher base 12 with a clincher 11B (See FIG. 13), a vertical link mechanism 13 for vertically moving the clincher base 12, a clincher mechanism 70 (See FIG. 4) for turning the clincher, and an encoder (second encoder) 80 for detecting a turned position of a driving shaft (second driving shaft) 16 mentioned later.

(Clincher Base)

Figure 2:
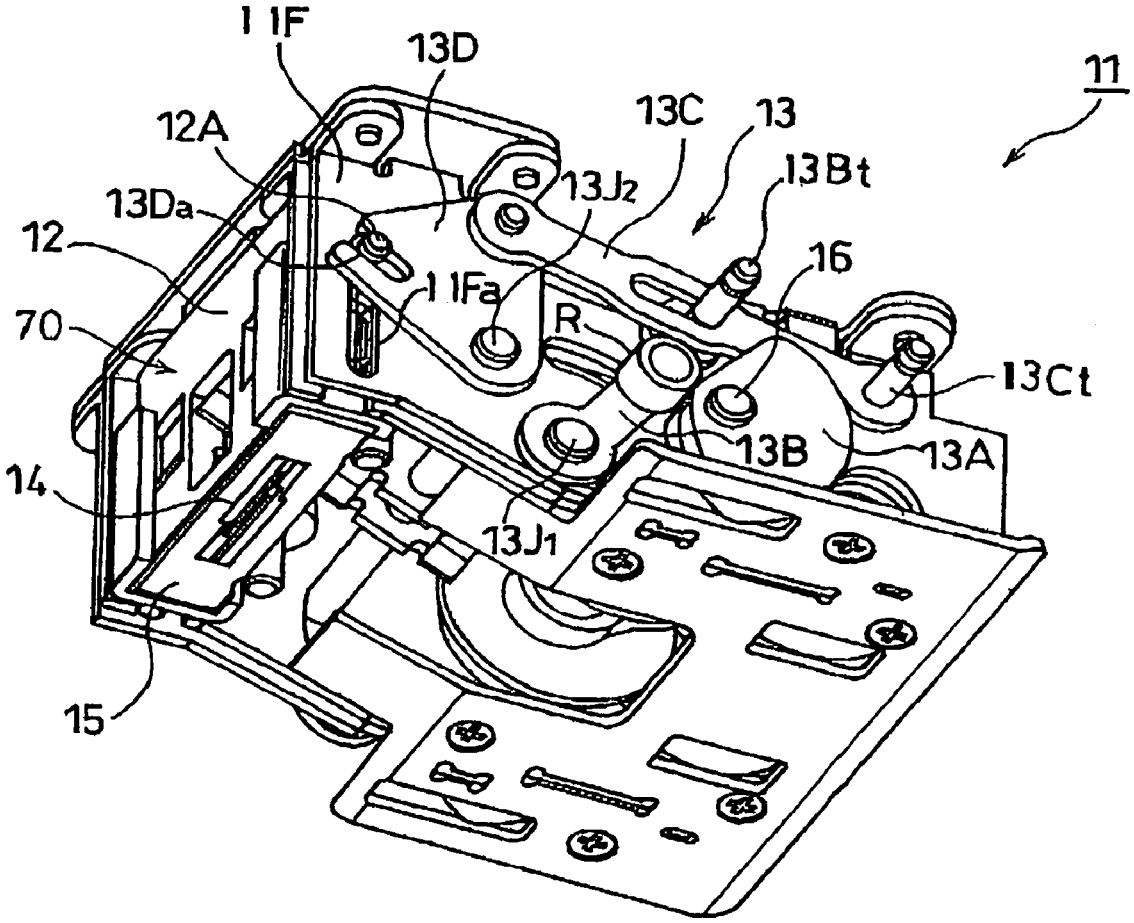
FIG. 2 is a perspective view showing a clincher unit.

As shown in FIG. 2, the vertical link mechanism 13 descends the clincher base 12 relative to a frame body 11F so that sheets P (See FIG. 13) may be sandwiched between the clincher base and a drive-out section 21 of the driver unit 20 (See FIG. 1). The clincher base 12 comprises a bottom portion 15 with an opening 14 through which leg portions of a staple 18 enter after passing the sheets P (See FIG. 13). The clincher 1B (See FIG. 13) is to clinch the leg portions of the staple 18 passing the opening 14.

(Vertical Clinching Mechanism)

Figure 3:
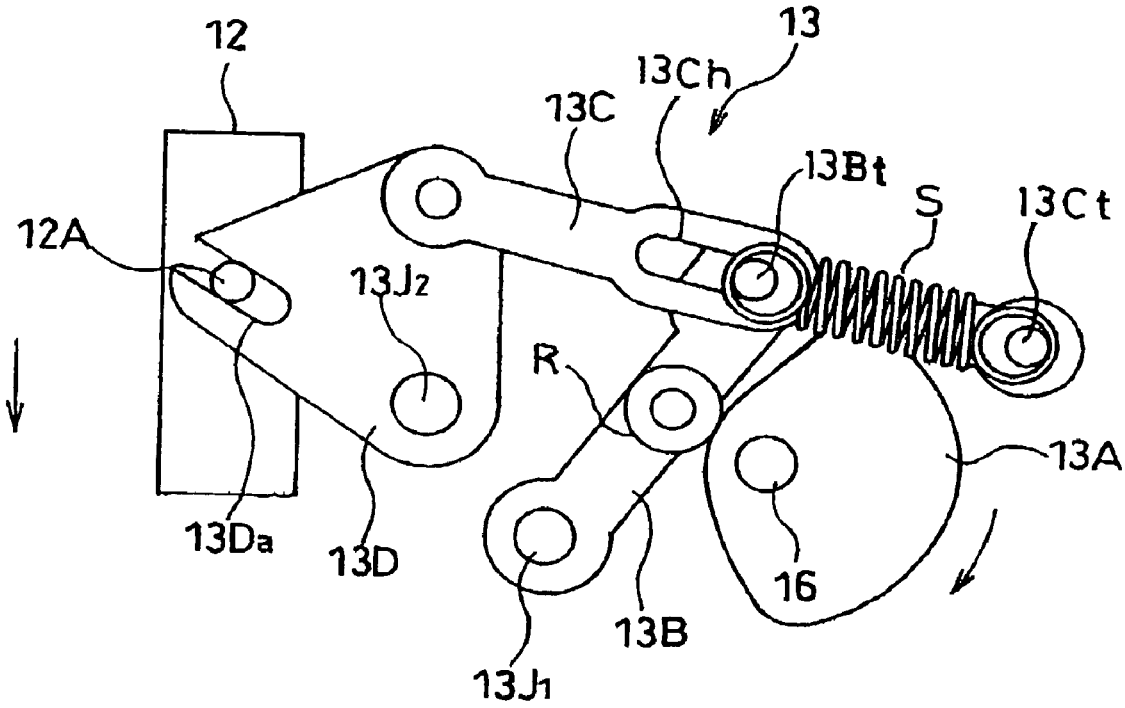
FIG. 3 is an explanatory view showing the construction of a vertical link mechanism

As shown in FIG. 3, the vertical link mechanism 13 comprises a link cam 13A mounted around the driving shaft 16 to be turned by a motor (second driving motor) 95 (See FIG. 12) of a driving mechanism not shown, a first link member 13B extending obliquely upwardly in a right direction from a shaft 13J1 in such a manner that the link member 13B may be turned around the shaft 13J1, a second link member 13C extending right and left from an upper portion of the first link member 13B, and an almost triangular third link member 13D to be turned around a shaft 13J2. The driving shaft 16 is rotatably fitted to the frame body 11F, and the shafts 13J1 and 13J2 are fitted to the frame body 11F of a clincher unit body 19.

An elongated hole 13Da is formed at a left side of the third link member 13D such that the hole 13Da obliquely upwardly extends in a left direction, and a leftmost side of the elongated hole 13Da is opened. A shaft 12A provided on the clincher base 12 is inserted into the elongated hole 13Da through an elongate hoe 11Fa of the frame body 11F (See FIG. 2).

A roller R is provided in an intermediate portion of the first link member 13B, and the roller R contacts a peripheral face of the link cam 13A. A projection 13Bt is provided at an upper portion of the first link member A left end portion of the second link member 13C is pivotably supported at an upper portion of the third link member 13D, which is urged in a clockwise direction around the shaft 13J2 with the spring S via the second link member 13C.

One end of the spring S is secured to the projection 13Bt of the first link member 13B, and the other is secured to a projection 13Ct provided at a right end of the second link member 13C.

One turn of the driving shaft 16 makes the clincher base 12 effect one vertically reciprocating motion by the link cam 13A and the link members 13B to 13D.

(Clincher Mechanism)

Figure 4:
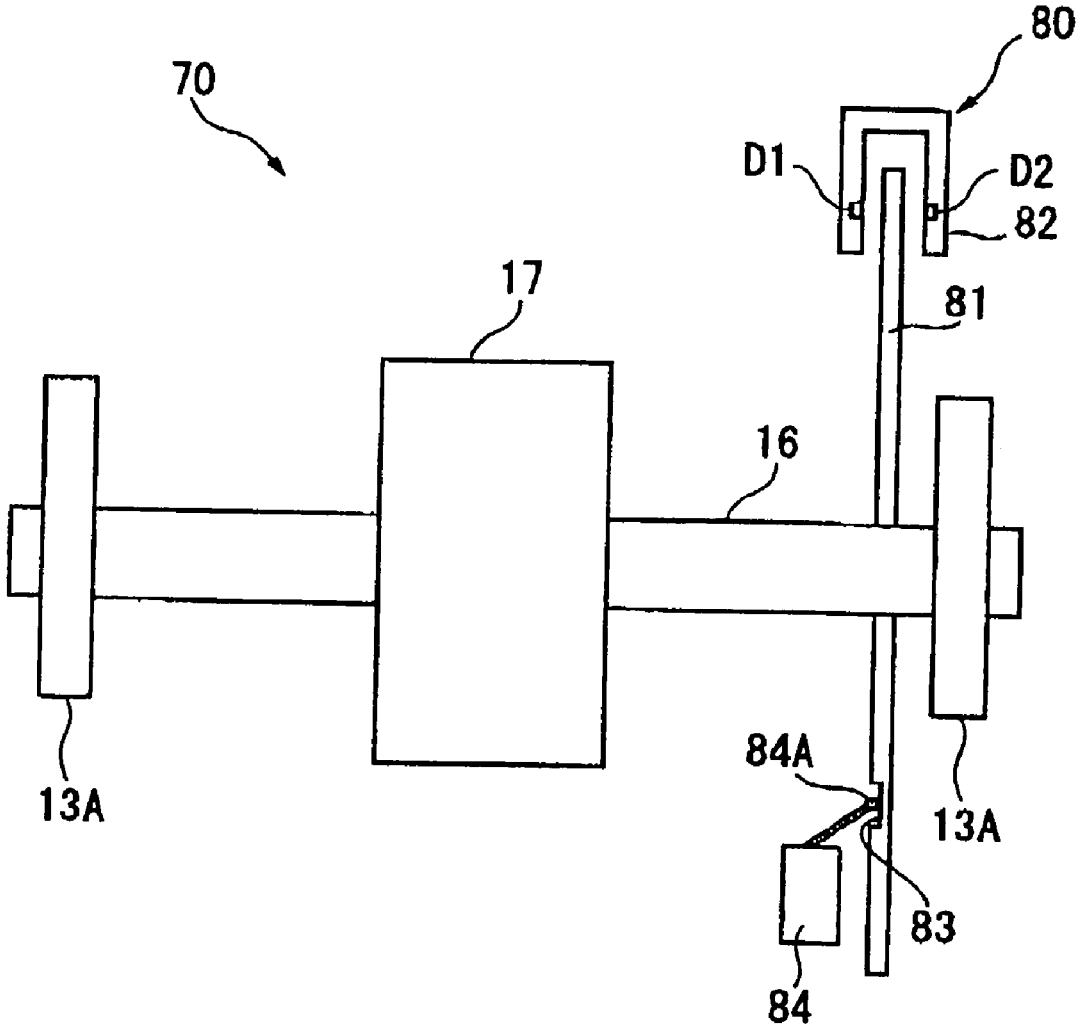
FIG. 4 is an explanatory view showing an encoder for the clincher unit.

As shown in FIG. 4, the clincher mechanism 70 comprises the driving shaft 16, a driving cam 17 fitted around the driving shaft 16, a link mechanism (not shown) for turning the clincher 11B via the driving cam 17, etc.

(Encoder)

The encoder 80 comprises a circular slit plate 81 fitted around the driving shaft 16 and a photo interrupter 82. The slit plate 81 has plural slit holes (not shown) extending radially and arranged in a peripheral direction at a given interval. The photo interrupter 82 comprises a light-emitting diode D1 for emitting light toward the slit plate 81 and a photo diode D2 for receiving the light passing the slit holes of the slit plate 81. The encoder 80 outputs a pulse signal every time when the photo diode D2 receives the light passing the slit hole of the slit plate 81.

At a side face of the slit plate 81 is provided a recess 83 for detecting a home position (initial position) of the clincher base 12. A micro switch 84 detects the recess 83. When a contact element 84A is located inside the recess 83, the micro switch 84 is turned off, whereas the micro switch 84 is turned on when the contact element 84 is located outside the recess 83.

(Driver Unit)

Figure 5:
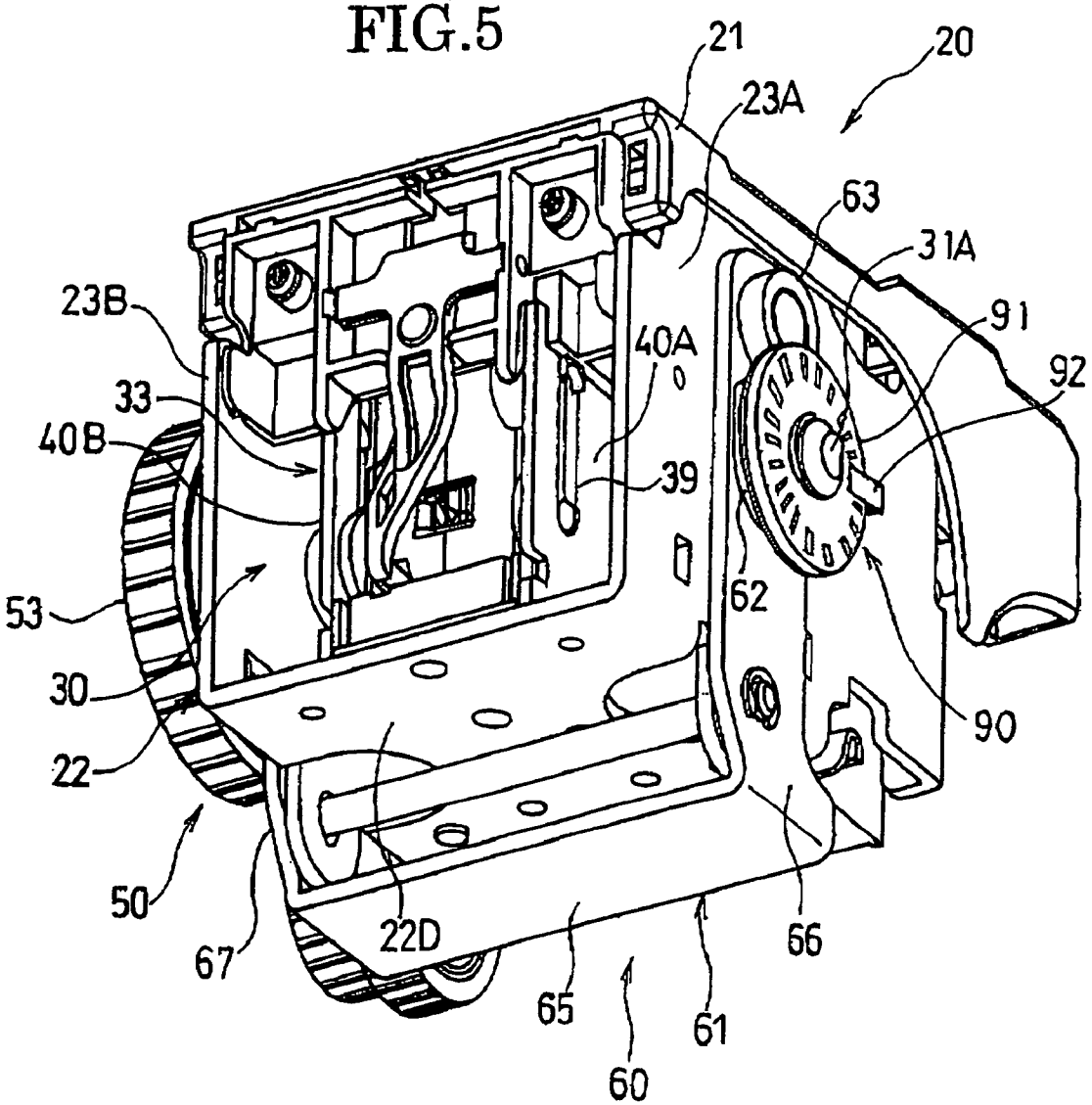
FIG. 5 is a perspective view showing the construction of a driver unit.

As shown in FIG. 5, the driver unit 20 comprises a drive-out mechanism 30 placed inside a rectangular channel-shaped frame 22, a cartridge (not shown) detachably attached into a magazine (not shown) in a sub-frame 33 fitted inside the frame 22, a feed mechanism (not shown) for feeding staples 18 piled and received in the cartridge to the drive-out section, a driving mechanism 50 for driving the feed mechanism and the drive-out mechanism 30, a braking mechanism (braking means) 60, and an encoder (first encoder) 90 for detecting a rotated location of a driving shaft (first driving shaft) 31 mentioned later. The driving mechanism 50 is provided at a side plate 23B of the fame 22.

(Drive-Out Mechanism)

Figure 6:
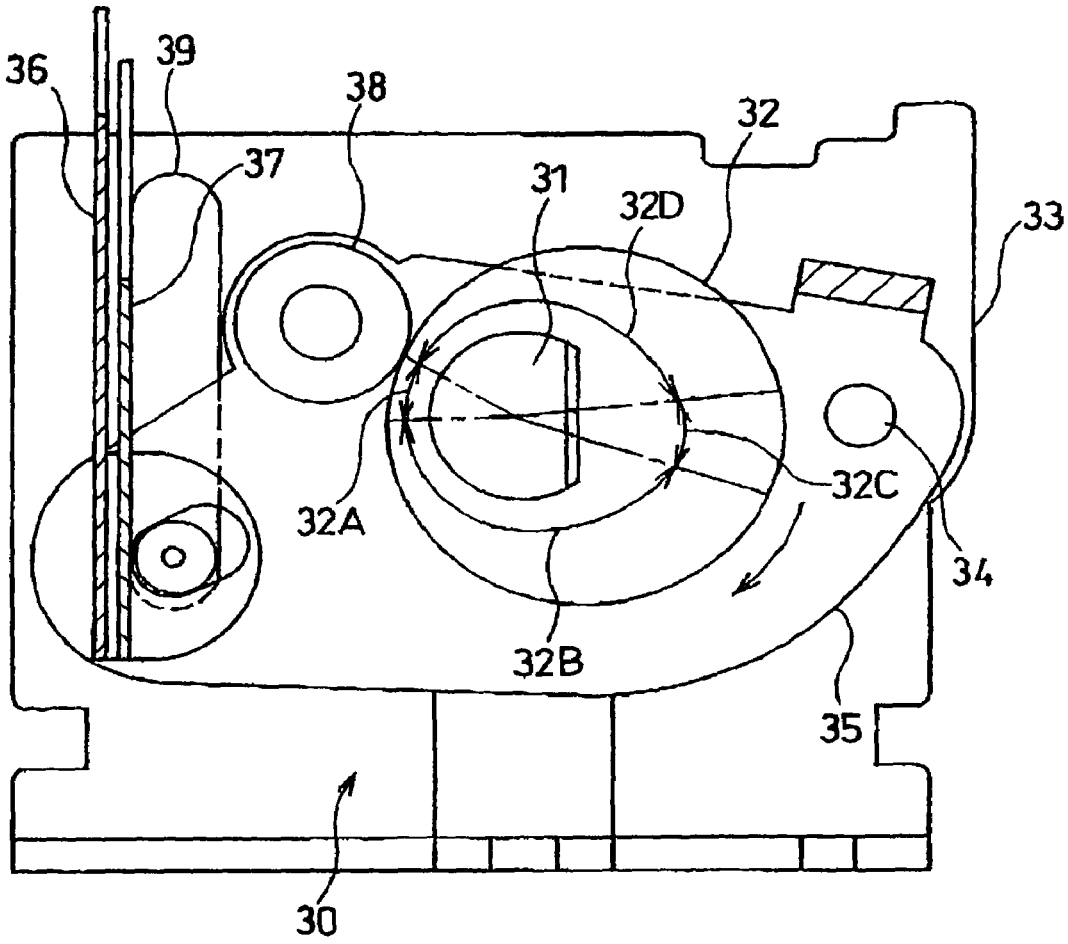
FIG. 6 is an explanatory view showing the construction of a drive-out mechanism

As shown in FIG. 6, the drive-out mechanism 30 comprises a driving shaft 31, a driver cam 32 attached to the driving shaft 31, a driver link 35 turnably fitted around a shaft 34 provided on a sub-frame 33, a driver 36 and a forming plate 37 attached to the driver link 35. As similarly to conventional cases, the driver cam 32 comprises a home position portion 32A, a forwarding portion 321B adapted for driving in the staple 18, a suppressing, portion 32C for holding the staple 18 driven in, and a returning portion 32D for descending the forming plate 37 and the driver 36.

At the driver link 35 is rotatably provided a roller 38 which contacts a peripheral face of the driver cam 32. The driver link 35 is turned reciprocally around the shaft 34 with rotation of the driver came 32, so that the driver 36 and the forming plate 37 are vertically moved along an elongated hole 39. That is, one turn of the driving shaft 31 makes one turn of the driving cam 32, which causes the driver ring 35 to make one reciprocal turn, which makes the driver 36 and the forming plate 37 to effect one vertical reciprocating movement.

(Driving Mechanism)

Figure 7:
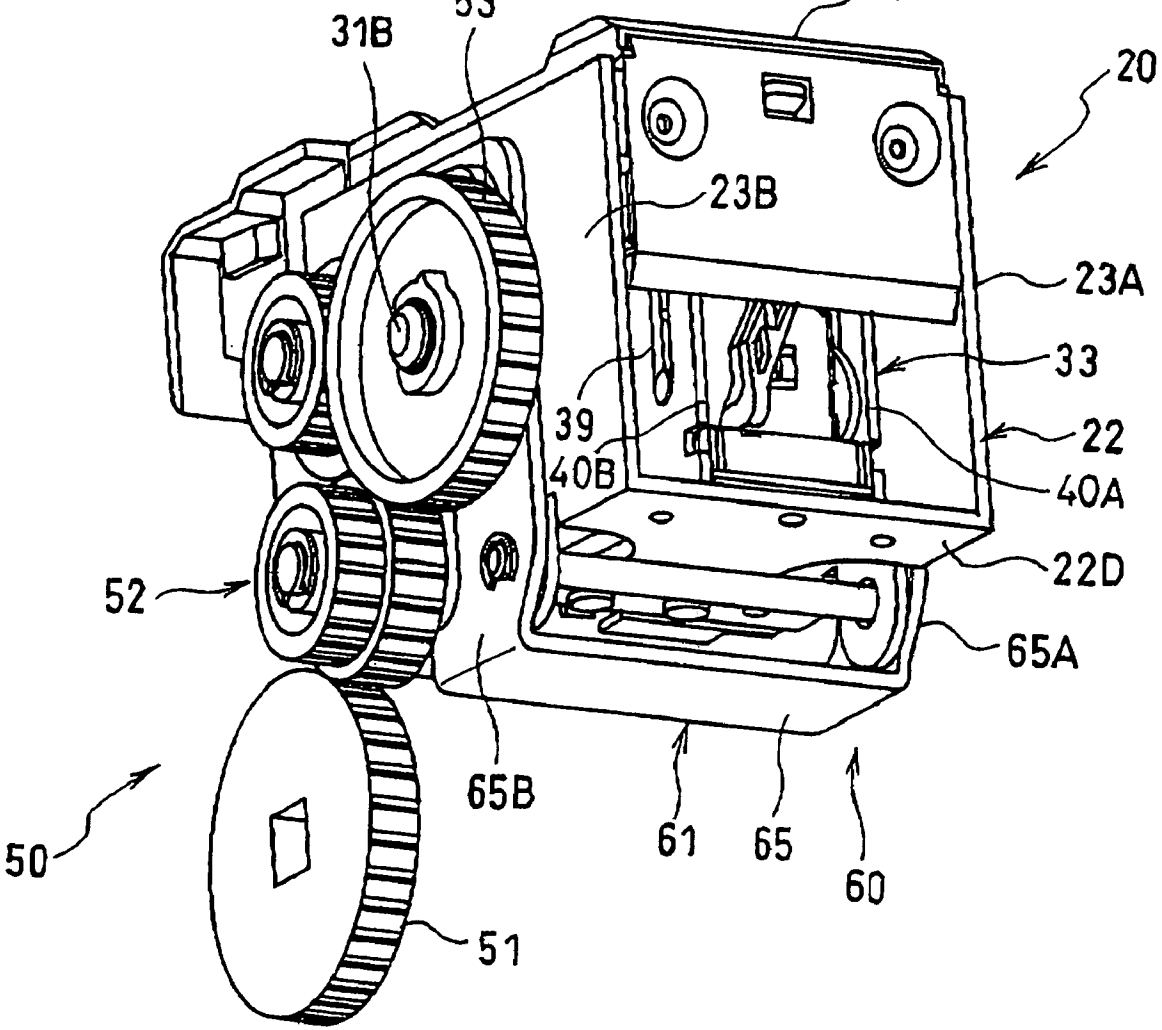
FIG. 7 is an explanatory view showing a driver cam fitted to a driving shaft, a braking cam and a follower gear.

As shown in FIG. 7, the driving mechanism 50 comprises a driving gear 51 fitted to a motor shaft of a motor (first driving motor) 96 (See FIG. 12), a reduction gear row 52 meshing with the driving gear 51, and a follower gear 53 meshing with the driving gear 1. The follower gear 63 is fitted to one end 31B of the driving shaft 31. Both ends 31A and 31B of the driving shaft 31 are projected outside side plates 23A and 23B of the frame 22 through side plates 40A and 40B of the sub-frame 33 (See FIG. 10).

(Encoder)

Figure 8:
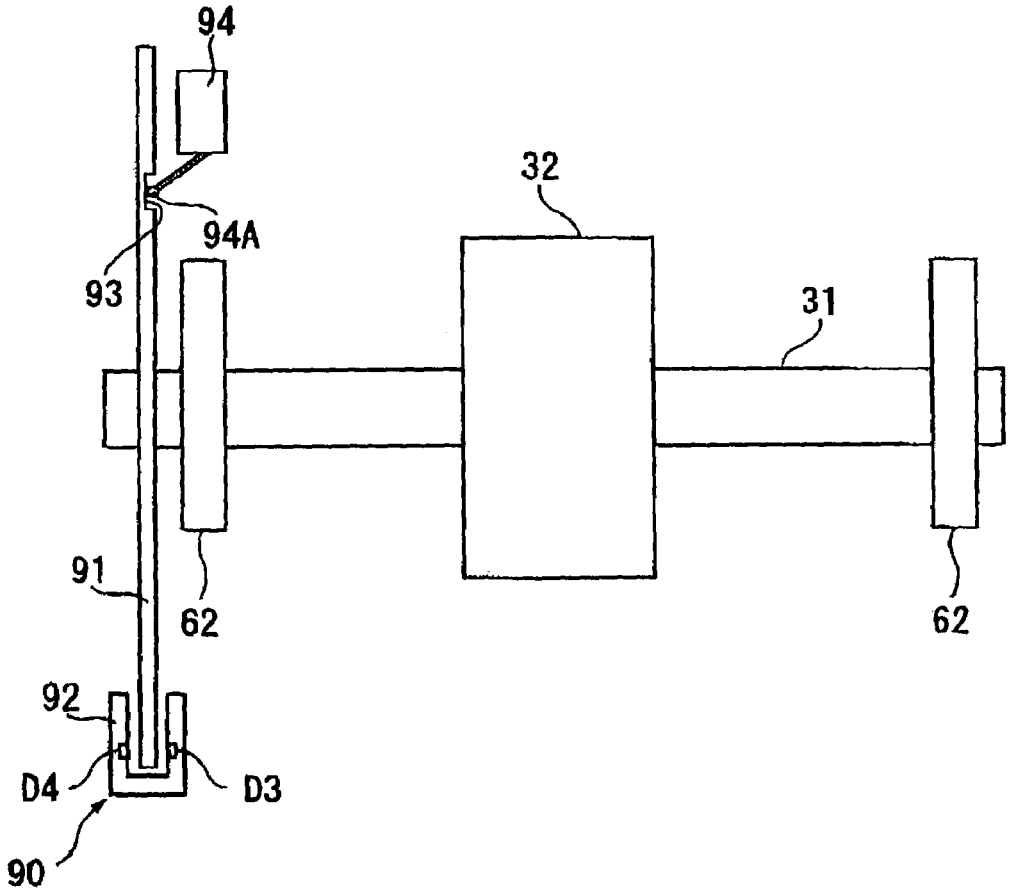
FIG. 8 is an explanatory view showing an encoder of the driver unit.

As shown in FIG. 8, the encoder 90 comprises a slit plate 91 fitted around the driving shaft 31 and a photo interrupter 92. The slit plate 91 has plural slit holes (not shown) extending radially and arranged in a peripheral direction at a given interval. The photo interrupter 92 comprises a light-emitting diode D3 for emitting light toward the slit plate 91 and a photo diode D4 for receiving the light passing the slit holes of the slit plate 91. The encoder 90 outputs a pulse signal every time when the photo diode D4 receives the light passing the slit hole of the slit plate 91.

At a side face of the slit plate 91 is provided a recess 93 for detecting a home position (initial position) of the driver 36. A micro switch 94 detects the recess 93. When a contact element 94A is located inside the recess 93, the micro switch 94 is turned off, whereas the micro switch 94 is turned on when the contact element 94A is located outside the recess 93.

(Braking Mechanism)

Figure 9:
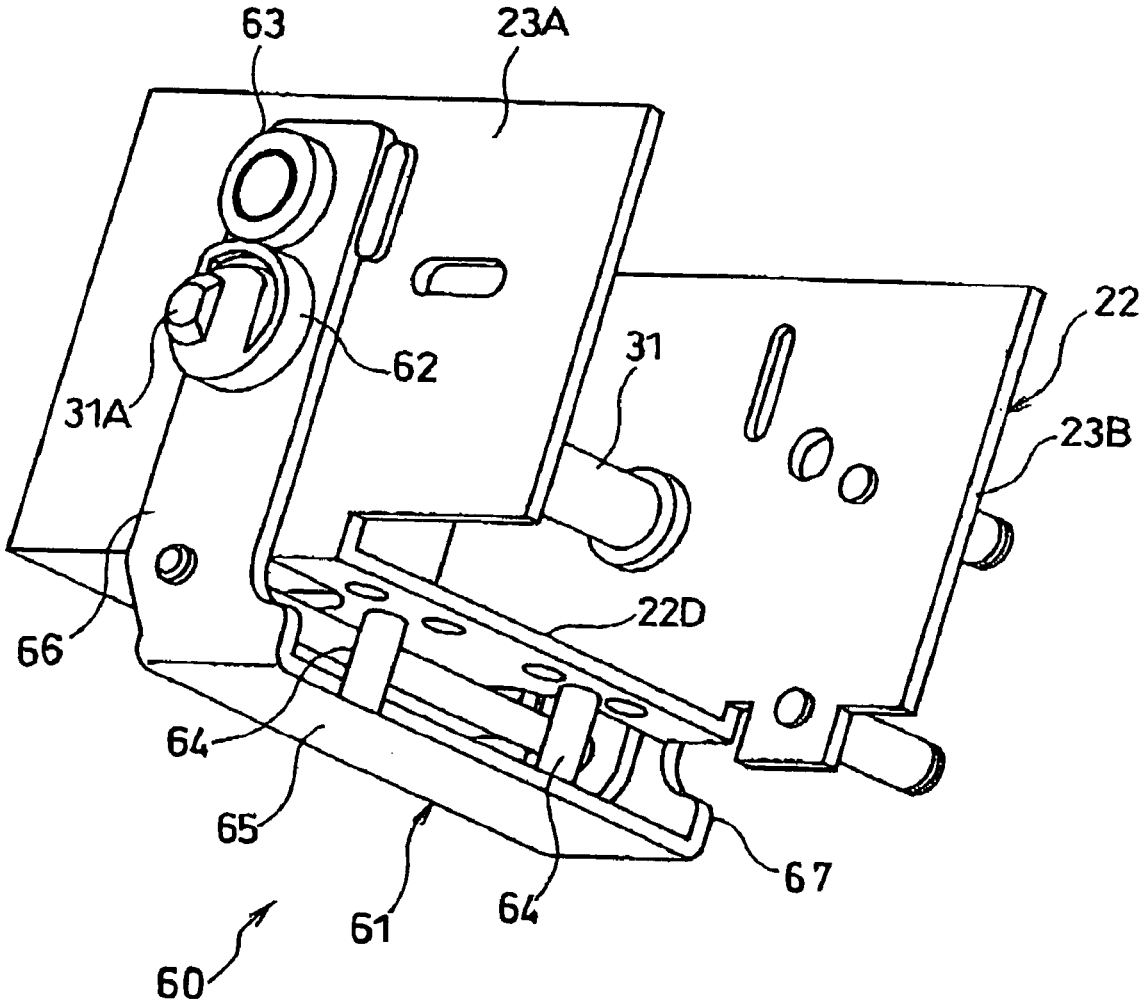
FIG. 9 is a perspective view showing the construction of a braking mechanism.
Figure 10:
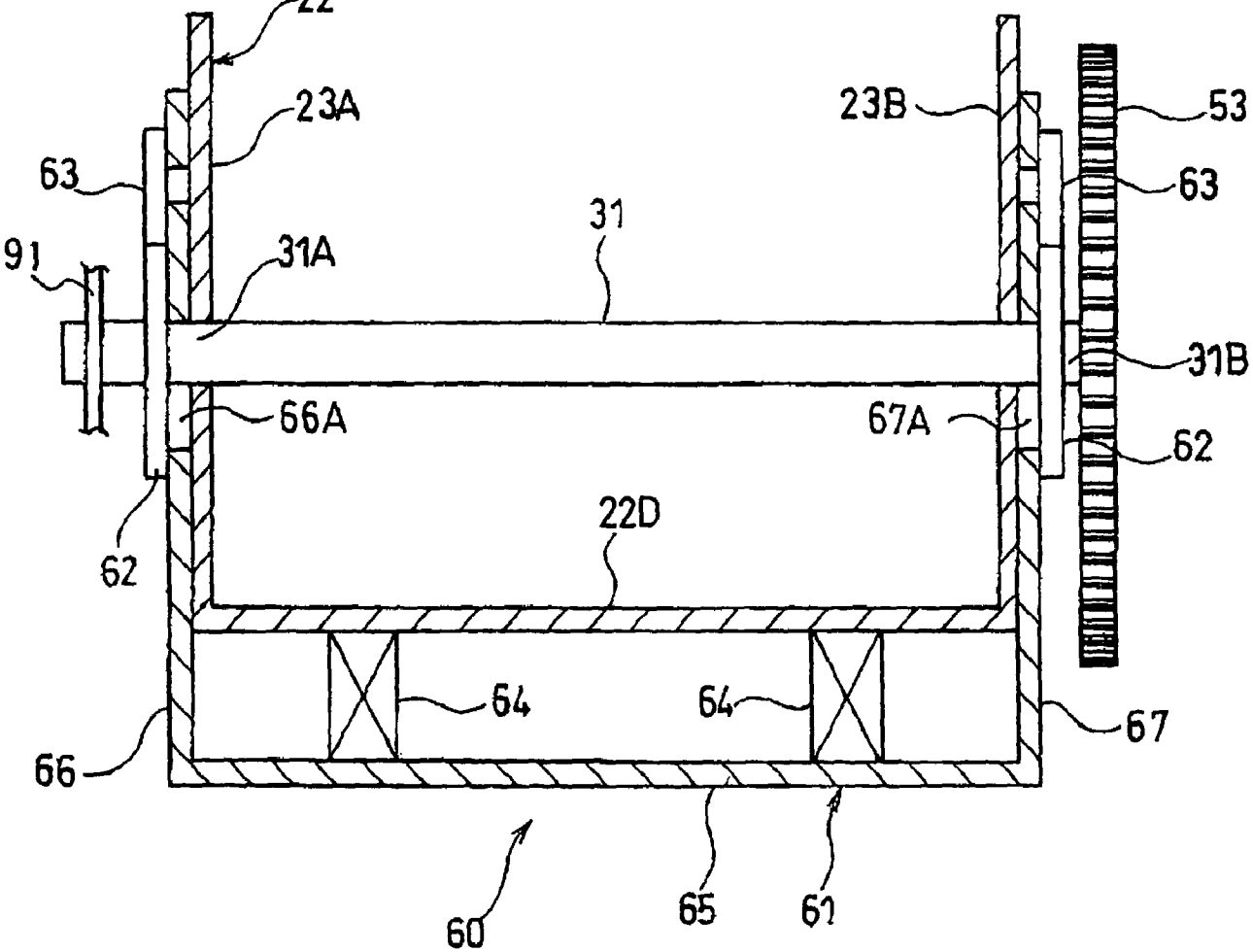
FIG. 10 is a sectional view showing the construction of the braking mechanism.

As shown in FIGS. 9 and 10, the braking mechanism 60 comprises a U-letter shaped braking frame 61 vertically movably attached to an outer side of the frame 22, a braking cam (brake cam) 62 attached to the other end 31A of the driving shaft 31, a roller (braking member) 63 contacting the braking cam 62, and a spring (urging member) 64, 64 provided between a bottom portion 22D of the frame 22 and a base plate 65 of the braking frame 61. The springs 64, 64 urge the braking frame 61 downwardly, and press contacts the roller 63 with the braking cam 62.

The braking frame 61 has side plates 66, 67 erected vertically from opposite ends of the base plate 65, and elongated holes 66A and 67A are vertically extended in the side plates 66, 67, respectively. Opposite end portions 31A, 31B are inserted through the elongated holes 66A, 67A of the side plates 66, 67, respectively. The elongated holes 66A and 67A enable the braking frame 61 to vertically move.

Figure 11:
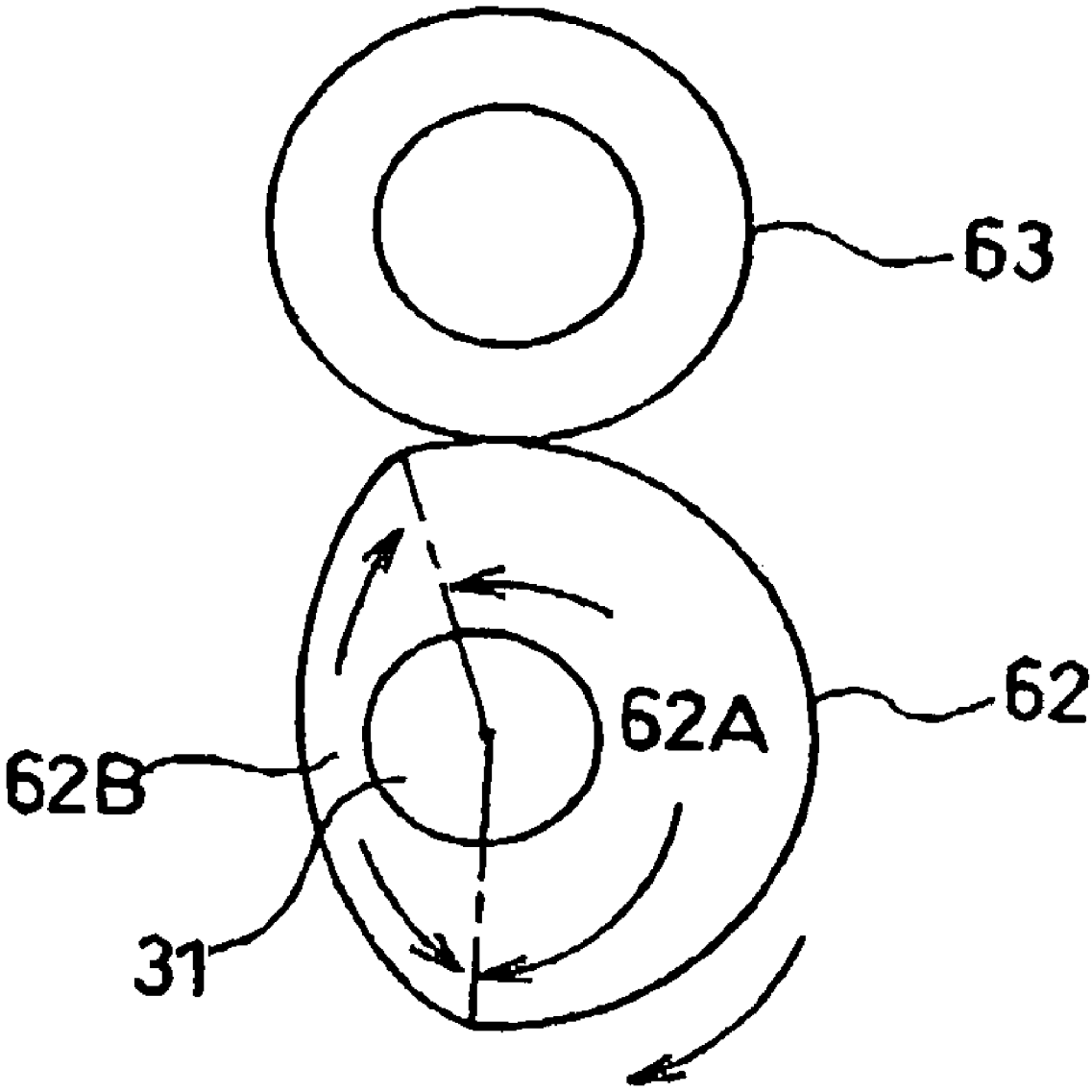
FIG. 11 is an explanatory view showing a braking cam and a roller.

As shown in FIG. 11, the braking cam 62 has a wide arcuate portion 62A and a narrow arcuate portion 62B. During when the driver 36 and the forming plate 37 are ascended, the roller 63 contacts the narrow arcuate portion 62B of the braking cam 62. On the other hand, during when the driver 36 and the forming plate 37 are descended, the roller 63 contacts the wide arcuate portion 62A of the braking cam 62. The roller 63 is rotatably provided at a side plate 66A of the braking frame 61.

Such a braking mechanism 60 is provided at the side plate 23B of the frame 22.

(Control System)

Figure 12:
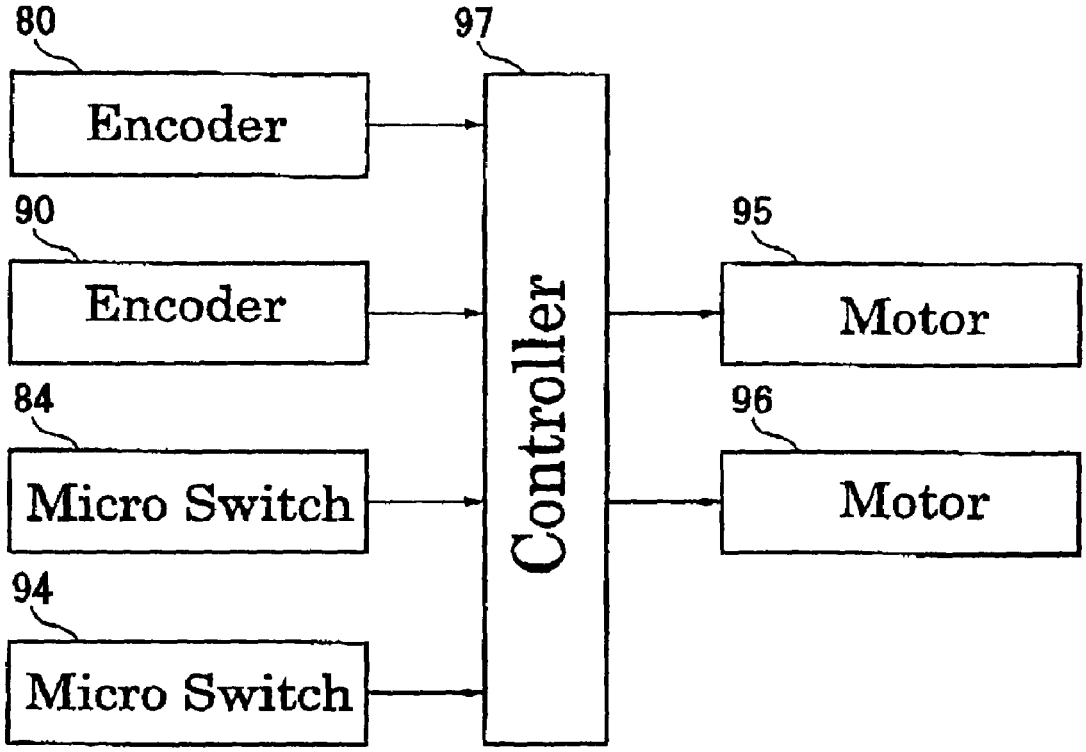
FIG. 12 is a block diagram showing the construction of a control system.

FIG. 12 shows the construction of a control system for the stapler 10. Referring to FIG. 12, a controller (controlling means) 97 counts pulses outputted from the encoders 80 and 90, and controls the motors 95 and 96 based on the number of the pulses counted and turning on and off of the micro switches 84 and 94. The controller 97 is constituted by a CPU, etc.

(Operations)

Next, operations of the stapler according to the above embodiment will be explained with reference to FIGS. 13 and 14.

Figure 13A:
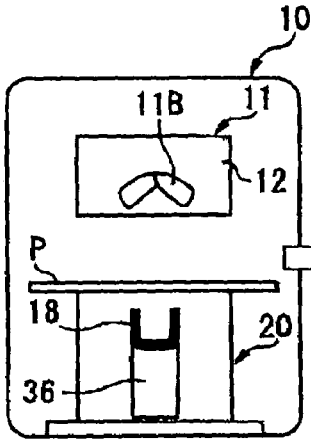
FIG. 13 is an explanatory view showing binding operations.
Figure 13B:
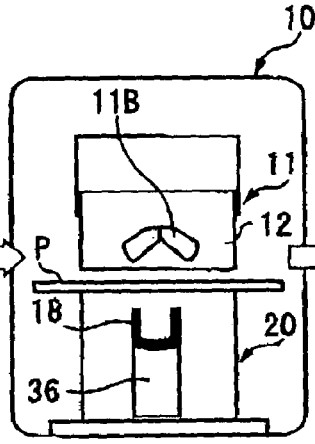
Figure 14:
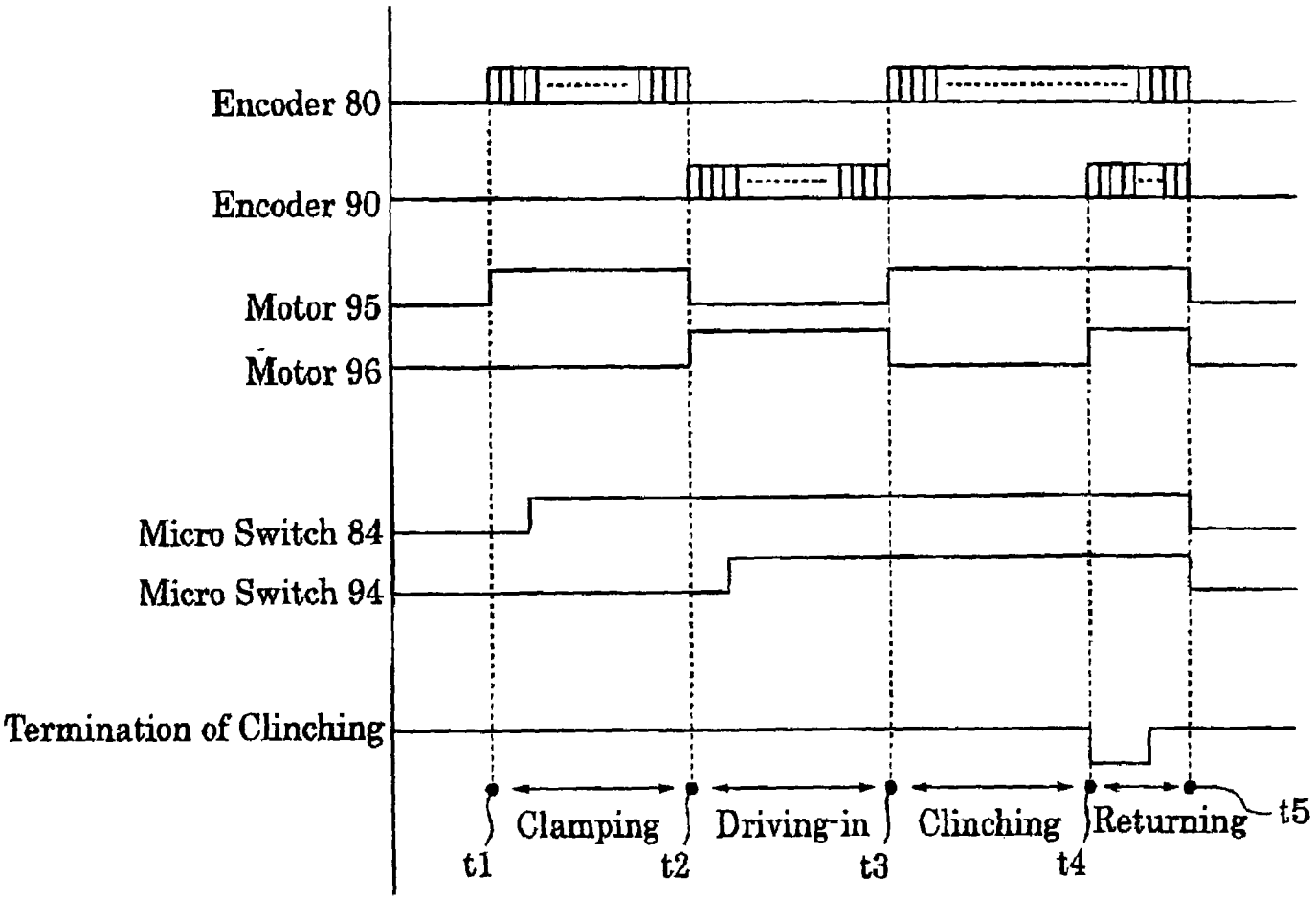
FIG. 14 is a time chart showing operations of the clincher unit and the driver unit.

Sheets P are discharged from a copier (not shown) and set in a binding position as shown in FIG. 13A. When a binding signal is outputted from the copier, the controller 97 drives the motor 95 of the driving mechanism for the clincher unit 11. Driving the motor 95 rotates the driving shaft 16 (point of time t1). Rotation of the driving shaft 16 causes the vertical link 13 to descend the clincher base 12 as shown in FIG. 13B. On the other hand, the rotation of the driving shaft 16 rotates the slit plate 81 together it, and a pulse is outputted from the encoder 80 every time when the slit plate 81 turns at a given angle. The pulses outputted from the encoder 80 are counted with the controller 97. Further, when the slit plate 81 is turned by said given angle, the contact element 84 of the micro switch 84 comes out from the recess 83 of the slit plate 81, thereby turning on the micro switch 84.

Figure 13C:
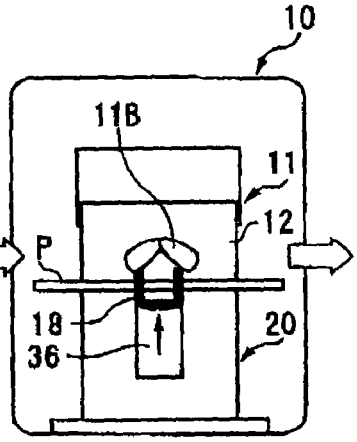

When the clincher base 12 is descended by a given distance, the sheets P is sandwiched between the clincher base 12 and the drive-out section 21 of the driver unit 20, so that the sheets P are clamped as shown in FIG. 13C. When the clamping is terminated and the number of pulses outputted from the encoder 80 reaches a given number (a set value) NA1 (point of time t2), the controller 97 stops the motor 95 and drives the driving motor 96 for the driver unit 20.

As the motor 96 is driven to rotate the driving shaft 31, the slit plate 91 of the encoder 90 is rotated together with the driving shaft 31. Rotation of the slit plate 91 makes the encoder 90 output pulses. Every time when the slit plate 91 is turned by a given angle, a pulse is outputted from the encoder 90. The pulses outputted from the encoder 90 are counted by the controller 97. Further, when the slit plate 91 is turned by said given angle, the contact element 94A of the micro switch 94 comes out from the recess 93 of the slit plate 91, thereby turning on the micro switch 94.

On the other hand, as the driving shaft 31 is rotated, the forwarding portion 32 of the driver cam 32 comes to contact the roller 38. During this time period, the driver link 35 turns clockwise around the shaft 34, so that the driver 36 and the forming plate 37 are ascended. The staple 18 is formed into a rectangular channel-shaped form by ascending the forming plate 37. As the forming plate 37 is further ascended, the staple 18 formed in the rectangular channel-shape by ascending the forming plate 37 as mentioned above is driven out from the drive-out section 21.

Leg portions of the staple 18 driven out from the drive-out section 21 pass the sheets P and enter into the opening 14 of the clincher base 12.

When the pulse signals outputted from the encoder 91 reaches a given number (set value) NB1 after the termination of the drive-out operation, the controller 97 stops the motor 97 and drives the motor 95 of the clincher unit 11.

Figure 13D:
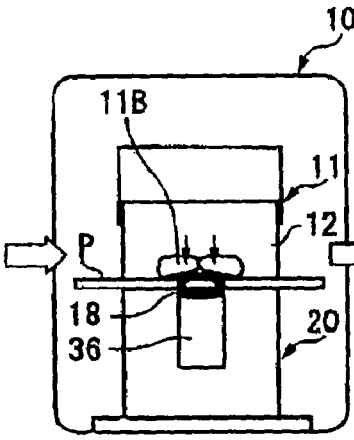

Driving the motor 95 rotates the driving shaft 16 of the clincher unit 11, which turns the clincher 11B by the driving cam 17 of the driving shaft via the link mechanism not shown. The leg portions of the staple 18 passing through the opening 14 of the clincher base 12 are clinched as shown in FIG. 13D by turning the clincher 11B. While the leg portions are being clinched, the holding portion 32C of the driver cam 32 contacts the roller 38 so that the driven-in staple 18 may be pressed with the driver 36.

On the other hand, since the braking cam 62 is turned clockwise (in FIG. 1) together with the rotation of the driving shaft 31, the narrow arcuate portion 62B of the braking cam 62 comes to contact the roller 63 during the time period when the forwarding portion 32B and the holding portion 32C of the driver cam 32 contact the roller 38, that is, during the time period from starting to terminating the ascending of the driver 36 and the forming plate 37. Owing to this, the braking frame 61 is descended from the home position with the urging force of the spring 64, as shown in FIG. 10. As a result, the press contact farce by which the roller 63 press contacts the braking frame 61 becomes smaller, so that almost no braking force hinders rotation of the driving shaft 31. Thus, no influence is produced on driving out the staple.

Figure 13E:
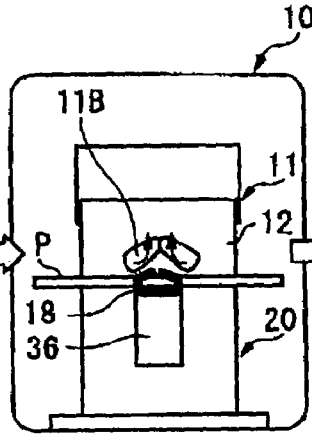
Figure 13F:
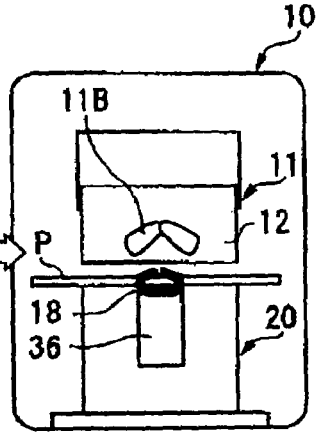
Figure 13G:
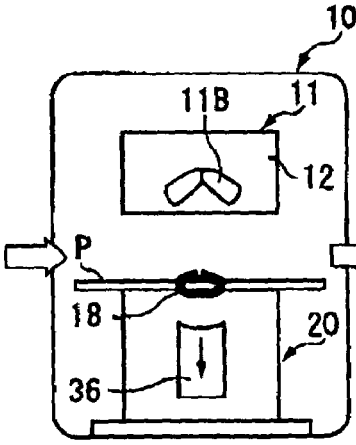

After clinching of the leg portions of the staple 18 is terminated, the number of pulses outputted from the encoder 80 reaches a given number (set value) NA2. When the number of the pulses counted by the encoder 80 reaches NA2, the controller 97 drives; the motor 95 of the clincher unit 11 and the motor 96 of the driver unit 20 (point of time t4). Driving the motor 96 rotates the driving shaft 31 of the driver unit 20 together with the rotation of the driver cam 32. The returning portion 32D of the driver cam 32 comes to contact the roller 38, and the driver link 35 is turned counterclockwise around the shaft 34. Turning the driver link counterclockwise descends the driver 363 and the forming plate 37 as shown in FIG. 13G.

As they are descended, the wider arcuate portion 62A of the braking cam 62 comes to contact the roller 63, and the braking frame 61 is moved up against the urging force of the springs 64. As the braking frame moves up, the press contact force by which the roller 63 press contacts against the braking frame 62 increases. As a result, the braking force is applied to the rotation of the driving shaft 31, and increases to slow the rotating speed of the driving shaft 31. Since no large load is applied to the motor 96 on descending the driver 36 and the forming plate 37, no problem occurs even when the braking force is applied to the driving shaft 31.

On the other hand, when the motor 95 turns after the point of time t4, the driving shaft 16 of the clincher unit 11 is turned. Thus, as shown in FIG. 13E, the clincher 11B is returned to the initial position by the driving cam 17 of the driving shaft 16 via the link mechanism not show. Thereafter, as shown in FIG. 13F, the clincher base 12 is ascended by the vertical link mechanism 13, and the clincher base 12 is returned to the original position as shown in FIG. 13G.

Figure 13H:
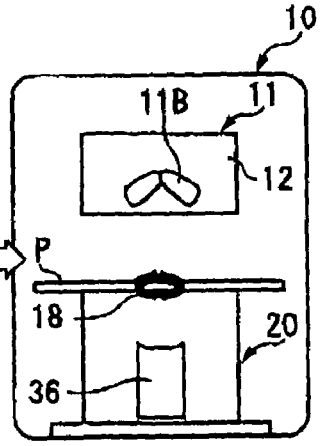

Rotating the motor 96 descends the driver 36 and the forming plate 37 back to their initial positions as shown in FIG. 13H. Then, the micro switch 94 detects the recess 93 of the slit plate 91, and outputs the home position signal at a L level. The home position signal from the micro switch 94 stops the driving of the motor 96 of the driver unit 20 (point of time t5).

When the driver 36 and the forming plate 37 are returned to their home positions (initial positions), the braking frame 61 reaches its upper dead point where the braking force is the maximum, while the rotating speed of the driving shaft 31 is the minimum. Therefore, if the driving of the motor is stopped when the driver 36 and the forming plate 37 are returned to their home positions, the driving shaft 31 can be assuredly stopped at a given position, in other words, at a position where the roller 38 contacts the home position portion 32A of the driver cam 32.

On the other hand, even after the clinching of the staple 18 is terminated, the motor 95 for the clincher unit 11 is driven, and the driving shaft 16 for the clincher unit 11 is turned. Turning the driving shaft 16 returns the clincher 11B via the driving cam 17 and the link mechanism, and the vertical link mechanism 13 ascends the clincher base 12. When the clincher base 12 returns to the initial position, the micro switch 84 detects the recess 83 of the slit plate 81 to output the home position signal at the L level. The home position signal from the micro switch 4 stops driving of the motor 96 for the clincher unit 11 (point of time t5).

According to the stapler 10 of the above-mentioned embodiment, the motors 95 and 96 are provided for the clincher unit 11 and the driver unit 20, respectively, to vertically move the clincher base 12, the driver 36, etc. This makes unnecessary the complicated link mechanism and so on for driving the clincher unit 11 and the driver unit 20 with a single motor, so that the structure of the stapler 10 can be simplified. Further, since the motors 95 and 96 are provided for the clincher unit 11 and the driver unit 12, respectively, they can be made to change their directions around their vertical axes. Thereby, the staple 18 can be piled into the sheets P in such a state that the crown portion is tilted to an edge of the sheets P.

Further, the motors 95 and 96 are alternatively driven to move the clincher unit 11 and the driver unit 20 alternatively, so that the sheets P are clamped, the staple 18 is driven into the sheets P and the staple is clinched. Since the motors 95 and 96 are controlled by the controller 97 based on the count number of the pulses outputted from the encoders 80 and 90, respectively, the operational timings at which the sheets P are clamped, the staple 18 is driven into the sheets P and the staple is clinched can be prevented from overlapping with one another, even if the motors 95 and 96 involve variations in characteristics and the links 13, 30, 50 and 70 also involve variations. This makes it possible to assuredly drive the staple into the sheets and perform various operations of the links and so on.

Further, since the sheets P placed on the driver unit 20 are clamped by descending the clincher base 12 of the clincher unit 11, the sheets P arrayed on clamping will not be disturbed. Therefore, the sheets P are bound always in the arrayed state Furthermore, the timings of operations of the clincher unit 11 and the driver unit 20 can be simply varied by changing the set values for the pulse numbers only.

(Effects of the Invention)

As mentioned above, according to the present invention, the mechanical construction of the stapler can be simplified, and the orientations of the driver unit and the clincher unit can be varied.

What is claimed is:

1. A stapler comprising a driver unit having a driver for punching out a staple toward sheets, said driver comprising a drive-out mechanism to drive out the staple when the driver is reciprocated, and the drive-out mechanism comprising a first driving shaft, a clincher unit having a clincher base comprising a clincher to clinch leg portion of the staple passing through the sheets, the driver unit being vertically separated from the clincher unit, said clincher comprising a clincher mechanism for clinching the leg portions of the staple passing through the sheets, said clincher mechanism comprising a second driving shaft, wherein the clincher base is disposed so as to vertically reciprocate, and the sheets are clamped between the clincher base and the driver unit when the clincher base is driven for reciprocation, the stapler further comprising a first driving motor provided for the driver unit to operate the driver, said first driving motor being configured to make the first driving shaft perform one reciprocating movement of the driver when the first driving shaft is rotated by one turn, a second driving motor provided for the clincher unit to reciprocate the clincher base and to operate the clincher, said second driving motor being configured to make the second driving shaft perform one reciprocating movement of the driver when the second driving shaft is rotated by one turn, a first detector for outputting a pulse every time when the first driving shaft turns by a given angle, a second detector for outputting a pulse every time when the second driving shaft turns by a given angle, and a controller for controlling the first and second driving motors based on the number of pulses outputted from the first and second detectors, respectively, wherein the second driving motor is driven to make the clincher base clamp the sheets between the driver unit, and then the second driving motor is stopped;

thereafter the first driving motor is driven to make the drive-out mechanism operate toward and drive out the staple through the sheets, and then the first driving motor is stopped;

thereafter the second driving motor is driven to make the clincher mechanism operate and clinch the leg portions of the staple having passed the sheets, the clincher base is returned, and then the second driving motor is stopped; and after the clinching operation is terminated, the first driving motor is driven to return the driver to an initial position, and then the first driving motor is stopped.

2. The stapler set forth in claim 1, wherein said first detector is a first encoder for outputting a pulse every time when the first driving shaft turns by a given angle; and said second detector is a second encoder for outputting a pulse every time when the second driving shaft turns by a given angle.

3. The stapler set forth in claim 1, wherein the clincher unit is disposed above the driver unit, the clincher unit moves downwardly, and the sheets placed on an upper face of the driver unit are clamped between the clincher base and the driver unit.

4. The stapler set forth in claim 1, wherein said first detector is a first encoder for outputting a pulse every time when the first driving shaft turns by a given angle; and said second detector is a second encoder for outputting a pulse every time when the second driving shaft turns by a given angle.

* * * * *